US007637443B2

(12) United States Patent
Scheffel et al.

(10) Patent No.: US 7,637,443 B2
(45) Date of Patent: Dec. 29, 2009

(54) FUEL INJECTOR

(75) Inventors: Martin Scheffel, Vaihingen (DE); Andreas Glaser, Stuttgart (DE); Jens Pohlmann, Besigheim (DE); Thomas Gerschwitz, Eberdingen (DE); Christina Gerescher, Asperg (DE)

(73) Assignee: Robert Bosch GmbH, Stuttgart (DE)

( * ) Notice: Subject to any disclaimer, the term of this patent is extended or adjusted under 35 U.S.C. 154(b) by 119 days.

(21) Appl. No.: 11/792,599

(22) PCT Filed: Oct. 5, 2005

(86) PCT No.: PCT/EP2005/055008

§ 371 (c)(1),
(2), (4) Date: Sep. 26, 2007

(87) PCT Pub. No.: WO2006/061269

PCT Pub. Date: Jun. 15, 2006

(65) Prior Publication Data

US 2008/0035116 A1 Feb. 14, 2008

(30) Foreign Application Priority Data

Dec. 6, 2004 (DE) ..... 10 2004 058 677

(51) Int. Cl.
*F02M 51/00* (2006.01)

(52) U.S. Cl. ..... 239/585.1; 29/890.124; 251/129.15

(58) Field of Classification Search ..... 251/129.15–129.21; 239/585.1; 29/890.124
See application file for complete search history.

(56) References Cited

U.S. PATENT DOCUMENTS

| | | | | |
|---|---|---|---|---|
| 4,643,359 | A * | 2/1987 | Casey | 239/585.4 |
| 5,330,153 | A | 7/1994 | Reiter | |
| 5,428,883 | A * | 7/1995 | Stieglitz | 29/602.1 |
| 6,302,371 | B1 | 10/2001 | Reiter | |
| 6,364,220 | B2 * | 4/2002 | Willke et al. | 239/585.1 |
| 2001/0002681 | A1 | 6/2001 | Willke et al. | |
| 2006/0076439 | A1 * | 4/2006 | Stier | 239/585.1 |
| 2006/0202049 | A1 * | 9/2006 | Miller | 239/5 |
| 2007/0221171 | A1 * | 9/2007 | Reiter | 123/445 |
| 2008/0061171 | A1 * | 3/2008 | Bayer | 239/585.3 |

OTHER PUBLICATIONS

International Search Report, PCT International Patent Application No. PCT/EP2005/0055008, dated Jan. 17, 2006.

Written Opinion of the International Searching Authority, PCT International Patent Application PCT/EP2005/055008, dated Jan. 17, 2006.

* cited by examiner

*Primary Examiner*—Thomas N Moulis
(74) *Attorney, Agent, or Firm*—Kenyon & Kenyon LLP

(57) ABSTRACT

A fuel injector, e.g., for fuel-injection systems of internal combustion engines in motor vehicles, includes a valve housing including a sleeve-shaped housing section; and a solenoid, situated on the housing section, having a coil brace, magnetic coil and magnetic cup. To protect the magnetic coil from salt fog that arises under specific environmental conditions and penetrates along the contact areas of solenoid and housing section, the coil brace with wound magnetic coil is completely enclosed on all sides by a one-piece plastic coat.

16 Claims, 2 Drawing Sheets

FUEL INJECTOR

FIELD OF THE INVENTION

The present invention is based on a fuel injector, in particular for fuel injection systems of internal combustion engines of motor vehicles.

BACKGROUND INFORMATION

In a conventional fuel injector the magnetic cup with coil brace and magnetic coil wound thereon is slipped over the sleeve-shaped housing section and placed on a lower housing part via its cup opening, the lower housing part fixing a valve-seat support in place on the sleeve-shaped housing section. Via the inner cylinder wall of its support body, the coil brace sits directly on the sleeve-shaped housing section and is surrounded by the cup wall of the magnetic cup with air clearance. The magnetic cup has a cup nipple, which extends axially along the cup base, is integrally formed with the cup base and encloses the sleeve-shaped housing part. Using machining, a circumferential labyrinth is cut into the outside of the cup nipple. A second labyrinth is introduced on the sleeve-shaped housing part by machining, with axial clearance from the cup nipple. The sleeve-shaped housing part and the cup nipple are enveloped by a plastic-extrusion coat on which a plug has been premolded to connect the magnetic coil to a mating plug. Due to the two labyrinths onto which the plastic is shrink-fitted, the magnetic coil is sealed from environmental influences, so that salt fog, which forms under certain environmental conditions, will not penetrate the transitions between the plastic of the plastic-extrusion coat and the metal of the sleeve-shaped housing part and travel along the metal walls to the magnetic coil to cause electrical damage there. Since the labyrinths are able to be produced only by machining, the production of these labyrinths is very expensive, which is reflected to a considerable extent in the production costs of the fuel injector.

SUMMARY

Example embodiments of the present invention may achieve uniformly excellent sealing of the magnetic coil from damaging environmental influences at low production expense an may provide that the outer diameter of the solenoid is able to be kept smaller with no change in the magnetic output. The labyrinth premolded on the coil shell in the fuel injector is easy to produce from a standpoint of production engineering and is already premolded during production of the coil brace. The die mold for producing the coil brace may have a simpler design since the labyrinth is omitted, and the overall axial height of the solenoid is able to be reduced as well with no change in the magnetic capacity. By appropriate adaptation of the material of the coil brace and the plastic of the plastic-extrusion coat and of the injection-molding parameters of the plastic, a homogenous connection between the coil brace and the plastic on the contact surfaces is achieved in the injection-molding operation.

The magnetic cup, the magnetic coil brace embedded in the magnetic cup by the plastic-extrusion coat and carrying the magnetic coil, the yoke integrated in the plastic coat and used for closing the magnetic circuit, as well as the plug premolded on the plastic coat for contacting the magnetic coil may form a prefabricated assembly unit. This assembly unit may be produced and delivered outside of the production line for the fuel injector, for instance by a supplier. In this manner, the cycle time required for the injection-molding operation of the plastic coat is not linked to the clock cycle of the production line of the fuel injector.

Example embodiments of the present invention are explained in greater detail in the following description with reference to the appended Figures.

DETAILED DESCRIPTION

Figure 1:
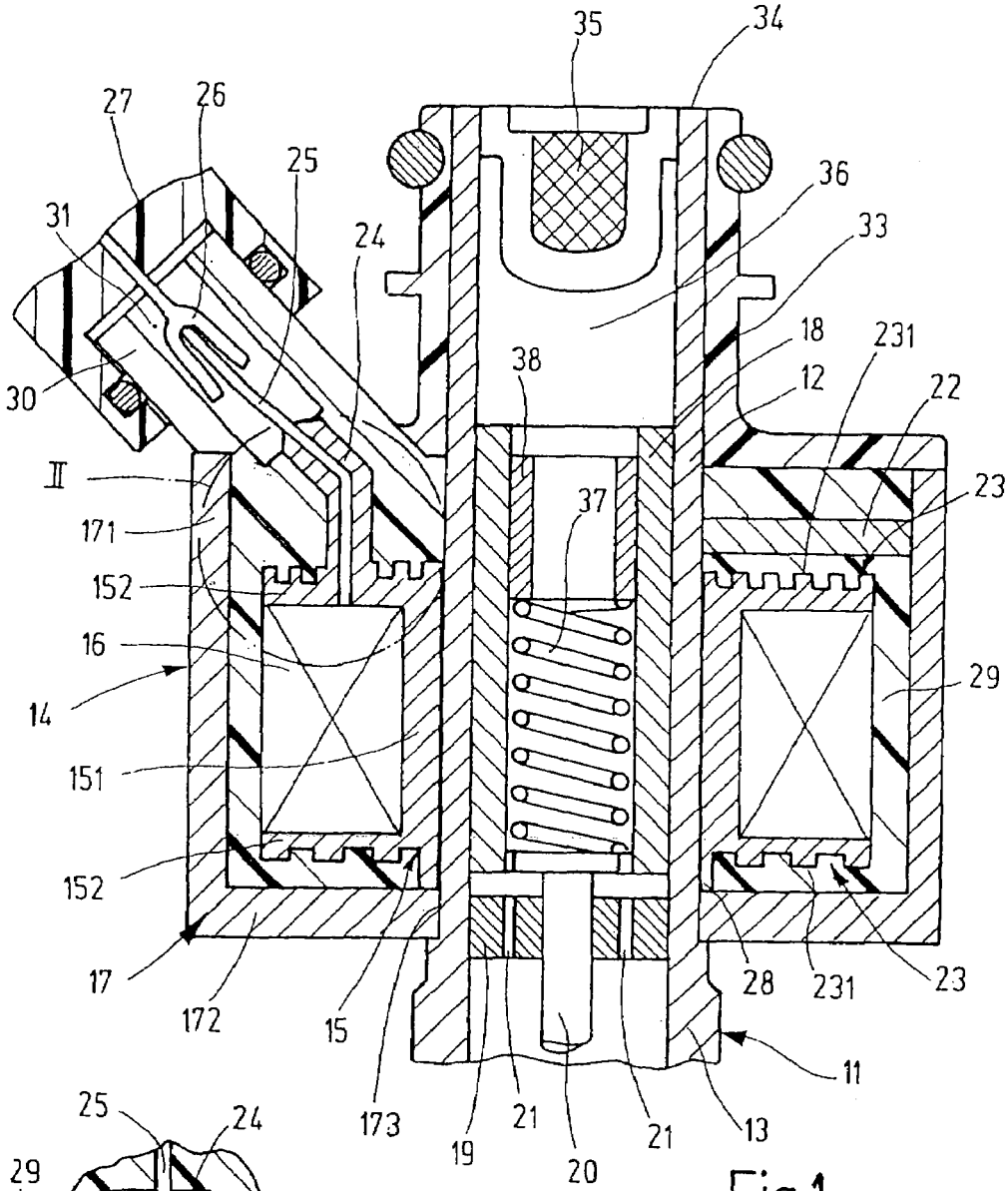
FIG. 1 is a cutaway view of a longitudinal section of a fuel injector.

The fuel injector schematically illustrated in FIG. 1 in longitudinal cross-section may be used in fuel-injection systems of internal combustion engines in motor vehicles. It has a valve housing 11 having a thin-walled, sleeve-shaped upper housing section 12 whose free end forms a connection nipple 34 for the fuel feed, and a lower housing section 13, which is integrally joined thereto and arranged as valve-seat support having a valve opening. As an alternative, the valve-seat support may also be inserted in lower housing section 13 as a separate component. Connection nipple 34 encloses a fuel-intake duct 36, which is sealed by a fuel filter 34 and continues through lower housing section 13 up to the valve opening. A solenoid 14 is situated on sleeve-shaped upper housing section 12. Solenoid 14 includes a coil brace 15, a magnetic coil 16 wound thereon, a magnetic cup 17 in which coil brace 15 is accommodated, and a sleeve-shaped solenoid core 18, which is inserted into sleeve-shaped, thin-walled upper housing section 12 and affixed therein so as to reduce the magnetic resistance and to form an air gap with respect to a magnetic armature 19 in the magnetic circuit of solenoid 14. Magnetic armature 19 lying opposite solenoid core 18 with an axial gap clearance is guided in valve housing 11 in a displaceable manner and permanently connected to a valve needle 20. To place solenoid 14 on upper housing section 12, cup base 172 of magnetic cup 17 is provided with a central base opening 173, so that cup base 172 rests against upper housing section 12. The magnetic circuit of solenoid 14 is closed by a yoke 22, which at least sectionally rests against the inner surface of cup wall 171 on the one side and against upper housing section 12 on the other side. Disposed in solenoid core 18 is a valve closure spring 37, which is braced on valve needle 20 and on an adjustment sleeve 38 pressed into solenoid core 18, and which presses valve needle 20 with its valve top onto the valve seat in the valve-seat support. The magnitude of the spring resilience of valve-closure spring 37 is defined by the insertion depth of adjustment sleeve 28.

Coil brace 15 has a hollow-cylindrical support body 151 and two support flanges 152 which delimit support body 151 at the front side. Magnetic coil 16 is wound onto support body 151 and axially fixed in place by support flanges 152. Premolded on both support flanges 152 is an axially projecting labyrinth 23, which is made up of a plurality of concentric bars 231. Also premolded on upper support flange 152 is an insulation dome 24, which encloses two electrical connector pins 25 for magnetic coil 16. Connector pins 25 are guided out of insulation dome 24 at its free end and configured for contacting the contact sockets 26 of a connector plug 27. Premolded on lower support flange 152 is a spacer 28, which creates a defined axial clearance of coil brace 15 with respect to cup base 172 of magnetic cup 17. Labyrinths 23, spacer 28 and insulation dome 24 are already premolded during the production process of coil brace 15 made of plastic.

Coil brace 15 having magnetic coil 16 is situated in magnetic cup 17 such that the inner wall of support body 151 facing away from magnetic coil 16 is able to be slipped directly onto sleeve-shaped upper housing section 12. Coil brace 15 lies inside magnetic cup 17 with radial clearance from cup wall 171 and with an axial clearance from cup base 172 that is predefined by a spacer 28. The free space between coil brace 15 having wound magnetic coil 16, and magnetic cup 17 is filled with injection-molded plastic material, which also coats upper support flange 152, so that coil brace 15 is enveloped by a plastic coat 29 that ends at sleeve-shaped upper housing section 12. When coil brace 15 is injection-molded, yoke 22 is integrated in plastic coat 29 on the one hand, and a plug 30 is premolded on plastic coat 29 on the other hand. Plug 30 has a recess 31 that terminates freely at its free end faces and is used to slide connector plug 27 on. Recess 31 is configured such that insulation dome 24 protrudes somewhat into recess 31, beyond its base. When sliding connector plug 27 onto plug 30, contact sockets 26 of connector plug 27 slide onto connector pins 25 projecting from insulation dome 24. During plastic-extrusion-coating, the plastic shrinks onto labyrinths 23 on support flanges 152 and seals magnetic coil 16 from sleeve-shaped upper housing section 12. The salt fogs that occur under certain environmental conditions and which penetrate between sleeve-shaped upper housing section 12 and coil brace 15 are then unable to reach magnetic coil 16 and damage it in the long term. Since insulation dome 24 projects beyond the base of recess 31 in plug 30, it is also prevented that the salt fog is able to reach magnetic coil 16 via the magnetic-coil connection.

Figure 2:
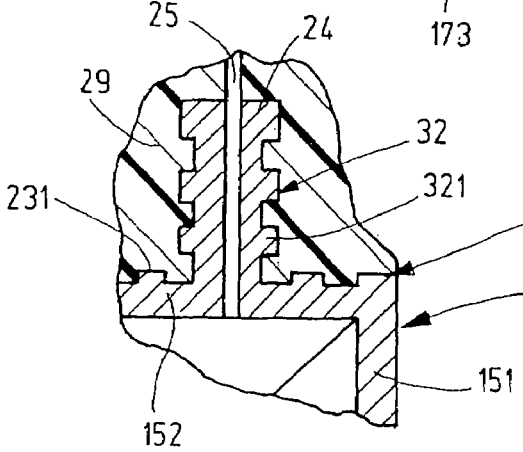
FIG. 2 is an enlarged view of the cutaway portion II illustrated in FIG. 1, with a modification of the fuel injector.

As an alternative, as illustrated in FIG. 2, insulation dome 24 may also end in front of recess 31 of plug 30. In this case, insulation dome 24 is provided with a circumferential labyrinth 32. In the exemplary embodiment illustrated in FIG. 2, labyrinth 32 is formed by three annular bars 321, which radially project from insulation dome 24 with axial clearance from one another.

The afore-described solenoid 14 having magnetic cup 17, coil brace 15, which is embedded in magnetic cup 17 by plastic coat 29 and supports magnetic coil 16, yoke 22 integrated in plastic coat 29, and plug 30 premolded on plastic coat 29 as one piece form a premanufactured assembly unit, which is slipped over sleeve-shaped upper housing section 12 of the fuel injector in its entirety. A plastic-extrusion coat 33 is then applied on plastic coat 29 on the upper side facing away from cup base 172, plastic-extrusion coat 33 enclosing connection nipple 34.

Figure 3:
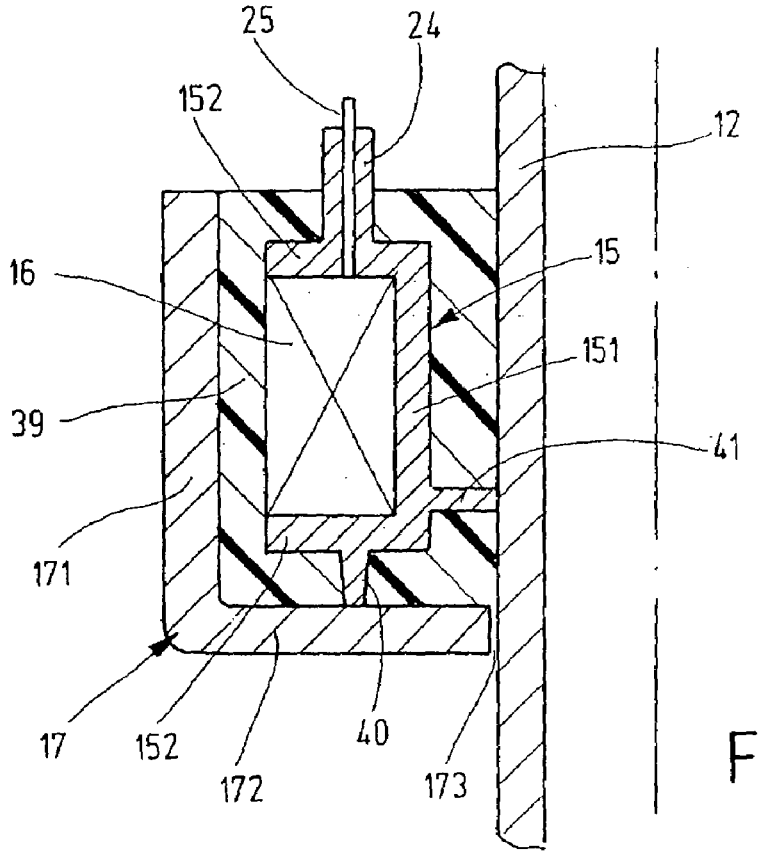
FIGS. 3 and 4 are semi-longitudinal cross-sectional views of a fuel injector according to exemplary embodiments.

FIG. 3 illustrates an exemplary embodiment for solenoid 14 inserted in the fuel injector according to FIG. 1. This exemplary embodiment differs from solenoid 14 described in connection with FIG. 1 in that coil brace 15 having magnetic coil 16 is completely enveloped by a one-piece plastic coat 39, i.e., is practically completely encapsulated in plastic. In this case, it is possible to dispense with the labyrinths on support flanges 152 and the labyrinth on insulation dome 24. Premolded on coil brace 15, which is inserted with radial clearance from cup wall 171 of magnetic cup 17, is a first spacer 40, which is braced on cup base 172, and a second spacer 41, which creates a radial clearance with respect to sleeve-shaped upper housing section 12 or with respect to the inner wall of plastic coat 39. To encapsulate coil brace 15 having wound magnetic coil 16, the free space between coil brace 15 and magnetic cup 17 on one side, and coil brace 15 and upper housing section 12 on the other side is completely filled with injection-molded plastic, which also coats support flange 152 facing away from cup base 172, and which encloses insulation dome 24 premolded on coil brace 15. An unmolding core, which replaces upper housing section 12, is inserted in magnetic cup 17 when injecting plastic coat 39.

Figure 4:
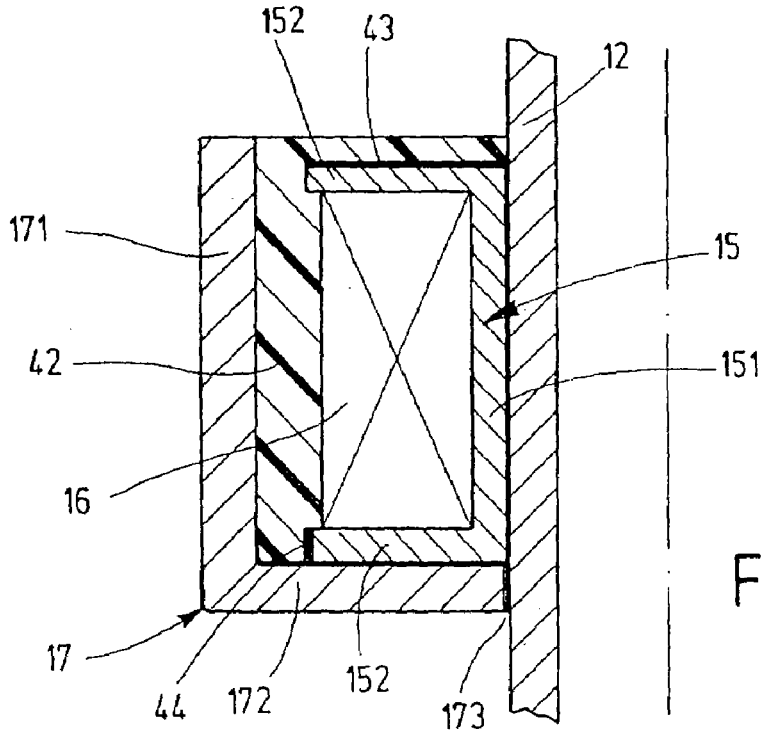

In order to decrease the dimensions of solenoid 14 in the radial and axial directions without reducing the volume of magnetic coil 16 and thus the output of solenoid 14, in the exemplary embodiment of solenoid 14 illustrated in FIG. 4, coil brace 15 is situated in magnetic cup 17 such that the inner wall of support body 151 facing away from magnetic coil 16 is able to be slipped over sleeve-shaped upper housing section 12. Coil brace 15 in turn is accommodated in magnetic cup 17 with radial clearance from cup wall 171, and rests on cup base 172 via its lower support flange 152. Here, too, plastic is injected into the remaining free space between coil brace 15 having wound magnetic coil 16 and magnetic cup 17, which coats support flange 152 facing away from cup base 172 up to housing section 12 and which forms a plastic coat 42 around coil brace 15. The plastic is adapted to the material of coil brace 15, and the injection parameters of the plastic such as temperature and injection pressure are selected such that the plastic and the material of coil brace 15 are integrally joined at contact areas 43, 44, so that magnetic coil 16 in turn is sealed from the boundary surface between support body 151 and sleeve-shaped housing section 12.

In an example embodiment, the pre-manufactured assembly unit is produced without magnetic cup 17, and this assembly unit, which is then made up of coil element 15, with magnetic coil 16, plastic coat 29, 39 or 42 with integrated yoke 22 and premolded plug 30, is installed in magnetic cup 17 on the assembly line of the fuel injector. Moreover, yoke 22 may also be removed from the assembly unit and placed on top of the cup opening of assembly cup 17 as a separate component during assembly of the fuel injector.

What is claimed is:

1. A fuel injector, comprising:

a valve housing including a sleeve-shaped housing section;

a solenoid arranged in the housing section having a coil brace with a support body and support flanges delimiting it at a front end;

a magnetic coil wound onto the support body; and a magnetic cup accommodating the coil brace, with a cup wall and a cup base in one piece therewith and enclosing the housing section with a base opening;

wherein the coil brace with the wound magnetic coil is completely enclosed on all sides by a plastic coat formed in one piece.

2. The fuel injector according to claim 1, wherein the fuel injector is arranged as a fuel injector for a fuel-injection system of an internal combustion engine in a motor vehicle.

3. The fuel injector according to claim 1, wherein the coil brace includes at least one spacer, which is braced on the cup base and creates an axial clearance with respect to the cup base, and at least one spacer, which creates a radial clearance with respect to the housing section, and wherein a free space between coil brace with wound magnetic coil and magnetic cup on one side, and between coil brace and wound magnetic coil and housing section on another side is completely injected with plastic forming the plastic coat, which also coats the support flange of the coil brace facing away from the cup base.

4. A fuel injector, comprising:

a valve housing having a sleeve-shaped housing section;

a solenoid arranged on the housing section, which has a coil brace with a support body and support flanges delimiting it at a front end;

a magnetic coil wound onto the support body;

a magnetic cup, accommodating the coil brace, with a cup wall and a cup base in one piece therewith and enclosing the housing section with a base opening;

wherein the coil brace is arranged in the magnetic cup such that an inner wall of the support body facing away from the magnetic coil is able to be slipped onto the housing section, an axially projecting labyrinth is premolded on the support flanges on an outside, and the coil brace with wound magnetic coil is coated by a one-piece plastic coat, which covers the support flanges and a surface area, facing the cup wall of the magnetic cup, of the magnetic coil and the support flanges.

5. The fuel injector according to claim 4, wherein the fuel injector is arranged as a fuel injector for a fuel-injection system of an internal combustion engine in a motor vehicle.

6. The fuel injector according to claim 4, wherein the coil brace lying inside the magnetic cup with radial clearance from the cup wall has at least one spacer braced on the cup base, and a free space between coil brace with wound magnetic coil and the magnetic cup is injected with a plastic forming the plastic coat, which also covers the support flange facing away from the cup base.

7. A fuel injector, comprising:

a valve housing having a sleeve-shaped housing section;

a solenoid arranged on the housing section, which has a coil brace with a support body and support flanges delimiting it at a front end;

a magnetic coil wound onto the support body; and a magnetic cup accommodating the coil brace, with a cup wall and a cup base in one piece therewith and enclosing the housing section with a base opening;

wherein the coil brace is arranged in the magnetic cup such that an inner wall of the support body facing away from the magnetic coil is able to be slipped onto the housing section, the cup base of the magnetic cup extends directly under and in contact with a lower support flange facing toward the cup base, the coil brace with wound magnetic coil is coated by a one-piece plastic coat, which covers a surface area of (i) the magnetic coil facing the cup wall of the magnetic cup, (ii) a support flange facing away from the cup base, and (iii) a portion of the lower support flange facing the cup wall, the one-piece plastic coat extending to and contacting the cup base, and contact areas of plastic coat and coil brace are fused together in a gas- and fluid-tight manner.

8. The fuel injector according to claim 7, wherein the fuel injector is arranged as a fuel injector for a fuel-injection system of an internal combustion engine in a motor vehicle.

9. The fuel injector according to claim 7, wherein the coil brace disposed in the magnetic cup with radial clearance from the cup wall rests on the cup base, and the free space between the coil brace with wound magnetic coil and the cup wall of the magnetic cup is filled with plastic forming the plastic coat, which also coats the support flange of the coil brace facing away from the cup base, and, in view of the material of the coil brace, is selected and defined in its injection parameters such that the plastic and the material of the coil brace are integrally joined.

10. The fuel injector according to claim 7, wherein an insulation dome, which encloses at least one electrical connector pin for the magnetic coil, is premolded on the support flange facing away from the cup base, the insulation dome being integrated in the plastic coat enclosing the coil brace with magnetic coil, and a plug, which has a central recess into which the at least one connector pin projects for contacting via a contact socket of a connector plug able to be slipped onto the plug, is premolded on the plastic coat.

11. The fuel injector according to claim 10, wherein the insulation dome is configured such that it protrudes into the recess, beyond its base.

12. A fuel injector, comprising:

a valve housing having a sleeve-shaped housing section;

a solenoid arranged on the housing section which has a coil brace with a support body and support flanges delimiting it at a front end;

a magnetic coil wound onto the support body; and a magnetic cup accommodating the coil brace, with a cup wall and a cup base in one piece therewith and enclosing the housing section with a base opening;

wherein:

the coil brace is arranged in the magnetic cup such that an inner wall of the support body facing away from the magnetic coil is able to be slipped onto the housing section;

a one-piece plastic coat coats the coil brace and wound magnetic coil such that the plastic coat covers a surface area of the magnetic coil facing the cup wall of the magnetic cup and at least a support flange of the coil brace facing away from the cup base;

contact areas of the plastic coat and coil brace are fused together in a gas- and fluid-tight manner;

a first plug:

is premolded on the plastic coat; and has a central recess into which at least one electrical connector pin for the magnetic coil projects for contacting via a contact socket of a connector plug, the connector plug being adapted for being slipped onto the first plug; and an insulation dome:

encloses the at least one electrical connector pin:

is premolded on the support flange facing away from the cup base;

is integrated in the plastic coat; and ends in front of the recess in the first plug and carries at its periphery a radially projecting labyrinth with which the plastic of the plastic coat engages.

13. The fuel injector according to claim 7, wherein a yoke of a magnetically conductive material, which connectable the cup wall with the housing section at least sectionally, is integrated in the plastic coat with axial clearance from the support flange facing away from the cup base.

14. The fuel injector according to claim 13, wherein the magnetic cup, the coil brace embedded in the magnetic cup by the plastic coat, supporting the magnetic coil, and the yoke integrated in the plastic coat, and the plug premolded on the plastic coat form a pre-manufactured assembly unit.

15. The fuel injector according to claim 13, wherein the plastic coat with the embedded coil brace supporting the installation coil, and the premolded plug and including integrated yoke form a pre-manufactured assembly unit.

16. The fuel injector according to claim 12, wherein:

the coil brace includes at least one spacer, which is braced on the cup base and creates an axial clearance with respect to the cup base; and a free space between the coil brace with wound magnetic coil and the magnetic cup is completely injected with plastic forming the plastic coat.

* * * * *